US008590214B2

(12) United States Patent
Laprise et al.

(10) Patent No.: US 8,590,214 B2
(45) Date of Patent: Nov. 26, 2013

(54) FOLDABLE ROOF FOR FOLDABLE HABITATION AND METHOD OF HANDLING AND STACKING FOLDABLE HABITATIONS

(75) Inventors: Daniel Laprise, Montmagny, CA (US); Mathieu Fortin, Caraquet (CA)

(73) Assignee: Habitaflex Concept Inc., Montmagny (CA)

( * ) Notice: Subject to any disclaimer, the term of this patent is extended or adjusted under 35 U.S.C. 154(b) by 96 days.

(21) Appl. No.: 13/320,846

(22) PCT Filed: May 17, 2010

(86) PCT No.: PCT/CA2010/000756

§ 371 (c)(1),
(2), (4) Date: Nov. 16, 2011

(87) PCT Pub. No.: WO2010/132989

PCT Pub. Date: Nov. 25, 2010

(65) Prior Publication Data

US 2012/0060430 A1 Mar. 15, 2012

Related U.S. Application Data

(60) Provisional application No. 61/179,547, filed on May 19, 2009.

(51) Int. Cl.
*E04B 7/16* (2006.01)

(52) U.S. Cl.
USPC ..... 52/66; 52/69; 52/71; 52/745.14

(58) Field of Classification Search
USPC ..... 52/66, 68, 69, 79.5, 143, 243.1, 65, 71, 52/745.14, 741.1; 446/478
See application file for complete search history.

(56) References Cited

U.S. PATENT DOCUMENTS

| | | | | | |
|---|---|---|---|---|---|
| 1,153,292 | A | * | 9/1915 | Downey | 52/69 |
| 3,348,344 | A | | 10/1967 | Tatevossian | |
| 3,460,297 | A | | 8/1969 | Fritz | |
| 3,701,225 | A | * | 10/1972 | Perry | 52/71 |
| 3,866,365 | A | | 2/1975 | Honigman | |
| 4,045,926 | A | | 9/1977 | Gibbs | |
| 4,065,891 | A | | 1/1978 | Burgin | |
| 4,074,475 | A | | 2/1978 | Wahlquist | |
| 4,155,204 | A | * | 5/1979 | Prozinski | 52/69 |
| 4,534,141 | A | | 8/1985 | Fagnoni | |
| 4,545,171 | A | * | 10/1985 | Colvin | 52/79.5 |
| 4,633,626 | A | | 1/1987 | Freeman et al. | |

(Continued)

FOREIGN PATENT DOCUMENTS

| | | |
|---|---|---|
| FR | 2557620 | 7/1985 |
| GB | 2085941 | 5/1982 |
| WO | 02066755 | 8/2002 |

OTHER PUBLICATIONS

International Search Report dated Sep. 8, 2010, mailed on Sep. 16, 2010.

*Primary Examiner* — Robert Canfield
*Assistant Examiner* — Babajide Demuren
(74) *Attorney, Agent, or Firm* — Christopher Casieri

(57) ABSTRACT

The foldable habitation has a foldable roof with a central section which can be folded into a generally flat configuration for transportation and storage, and which can be automatically deployed into a chevron shape upon deploying lateral sections of the roof. A novel method of handling a foldable habitation is also disclosed.

10 Claims, 10 Drawing Sheets

(56) References Cited

U.S. PATENT DOCUMENTS

| | | | | | |
|---|---|---|---|---|---|
| 4,635,412 | A | | 1/1987 | Le Poittevin | |
| 4,636,412 | A | | 1/1987 | Field | |
| 4,660,332 | A | * | 4/1987 | Colvin, Jr. | 52/79.5 |
| 4,780,996 | A | | 11/1988 | Julien, Jr. | |
| 4,891,919 | A | | 1/1990 | Palibroda | |
| 4,912,891 | A | | 4/1990 | Bertrand | |
| 4,989,379 | A | | 2/1991 | Suzuki | |
| 5,447,000 | A | | 9/1995 | Larsen | |
| 5,461,832 | A | * | 10/1995 | Smith | 52/69 |
| 5,596,844 | A | | 1/1997 | Kalinowski | |
| 5,605,018 | A | * | 2/1997 | McElderry et al. | 52/57 |
| 5,778,604 | A | | 7/1998 | Snow | |
| 5,966,956 | A | | 10/1999 | Morris et al. | |
| 6,983,567 | B2 | | 1/2006 | Ciotti | |
| 2004/0194396 | A1 | | 10/2004 | Shanni | |
| 2005/0044804 | A1 | * | 3/2005 | Bin et al. | 52/79.5 |
| 2005/0120639 | A1 | * | 6/2005 | Bucher et al. | 52/64 |
| 2006/0081628 | A1 | | 4/2006 | Myers et al. | |
| 2006/0225369 | A1 | | 10/2006 | Napier | |
| 2006/0225371 | A1 | | 10/2006 | Shanni | |
| 2008/0236055 | A1 | | 10/2008 | Laprise | |

* cited by examiner

FOLDABLE ROOF FOR FOLDABLE HABITATION AND METHOD OF HANDLING AND STACKING FOLDABLE HABITATIONS

CROSS-REFERENCE TO RELATED APPLICATIONS

This application is a 371 application of PCT/CA2010/000756 filed May 17, 2010, which claims priority to the US Provisional Application 61/179,547 filed May 19, 2009.

BACKGROUND

Typical design concerns in foldable habitations is the ease of deployability, and the facility of transportation. In particular, foldable habitations which involve a lesser number of deploying steps, either requiring the assembly of a lesser number of components or attachments, or just being generally simpler to deploy in general, have been favored by consumers over foldable habitations which were more complex to deploy. There is thus a general need in the art for simple deploying configurations. Facility of transportation is also a concern, particularly when designing foldable habitations which are to be transported overseas by boats.

The roof is a particularly important section of any type of habitation and the design thereof is particularly complexified in the case of foldable habitations due to the challenge in rendering any hinged or otherwise folding junction thereof leak-proof. A traditional approach in the field of foldable habitations was thus to minimize the amount of folds in the roves thereof The foldable habitation published in U.S. Patent Application Pub. No. 2008/0236055, referred to above, had a roof with a rigid chevron-shaped center section fixedly mounted to a structural core of the foldable habitation leading to sloping side sections on each side. Overseas transportability was provided by shipping on a "flat rack" type ISO containers. Inside the ship, these foldable habitations could only be received on the top of stacks of shipping containers, which rendered shipping more costly. This foldable habitation was thus satisfactory to a certain degree, but there remained unaddressed needs, including the ability to stack other merchandise above it during overseas shipping, facilitating handling, and achieving a more optimal use of the rectangular prism shaped shipping volume allotted inside the ship; otherwise said, bringing the foldable habitation in better conformity with usual shipping practices.

SUMMARY

In accordance with one aspect, the center section of the roof was made foldable between a generally flat transport configuration and the chevron-shaped deployed configuration. There were particular challenges in providing such foldability while maintaining any resulting loss of deployability of the habitation manageable, which the embodiment described herein and illustrated achieves in a satisfactory manner by the use of a quintuple-hinge configuration.

In accordance with another aspect, a structural core section of the foldable habitation is used as a support, onto which shipping frames are affixed at opposite ends of the foldable habitation in the transport configuration. Two or more foldable habitations can thus now be stacked during shipping without corresponding shipping containers, by stacking the shipping frames mounted to corresponding foldable habitations atop one another. The shipping frames thus provide stacking structure which was formerly provided by the shipping containers.

In accordance with one aspect, there is provided a roof for a foldable habitation also having a structural core, a floor and walls, and being foldable between a transport configuration and a deployed configuration, the roof having a center section including two interconnected center section panels, each having a proximal edge and a distal edge and both being positioned above the structural core of the foldable habitation, and two lateral sections, the foldable roof being CHARACTERIZED IN THAT the two lateral sections are each foldably connected to a corresponding opposite side of the structural core of the foldable habitation, about two first fold axes, in that the two center section panels are each foldably connected at their distal edge to the corresponding lateral section, about two second fold axes, and each foldably connected to one another at their proximal edge, the first fold axes being interspaced from the corresponding second fold axis in a manner that the center section panels are automatically deployed into a chevron shape upon deploying the lateral sections of the roof In accordance with another aspect, there is provided a method of deploying a roof of a foldable habitation with a structural core, comprising : deploying a lateral section of the roof by pivoting it relative to the structural core about a first horizontal axis located along an edge of the lateral section, the first horizontal axis being inwardly spaced from a covering plane of the lateral section of the roof, and thereby rotating a second horizontal axis located along the edge of the lateral section between the covering plane and the first axis and raising a center section of the roof foldably connected to the lateral section of the roof about the second horizontal axis.

In accordance with another aspect, there is provided a foldable roof system for a foldable habitation having a structural core, the foldable roof system having two sides, each side comprising : a lateral roof section having a covering plane, and an edge foldably connected to a corresponding side of the structural core about a first fold axis being spaced away from the covering plane by a first distance, a center section panel having a distal edge foldably connected to the lateral roof section about a second fold axis being spaced away from the planar covering by a second distance which is lesser than the first distance, and a proximal edge; the center section panels of each side being foldably connected to one another at the proximal edge.

In accordance with another aspect, there is provided a method of stacking two or more foldable habitations in a transport configuration, the method comprising : mounting two support frames to a structural core of each of the foldable habitations, at opposite ends thereof moving a first one of the foldable habitations into a first position, and moving a second one of the foldable habitations into a second position, located above the first position, in which the second foldable habitations is supported by the two support frames of the second foldable habitation and the two support frames of the second foldable habitation are supported by the two support frames of the first foldable habitation located below.

It is understood that foldable habitations have panels with edges which are pivotally connected to edges of other panels. For the sake of simplicity, the expression "foldable connection" is used herein to refer to this type of pivotal connection. Such foldable connections are generally, but not necessarily, hinged.

DETAILED DESCRIPTION

Figure 1:
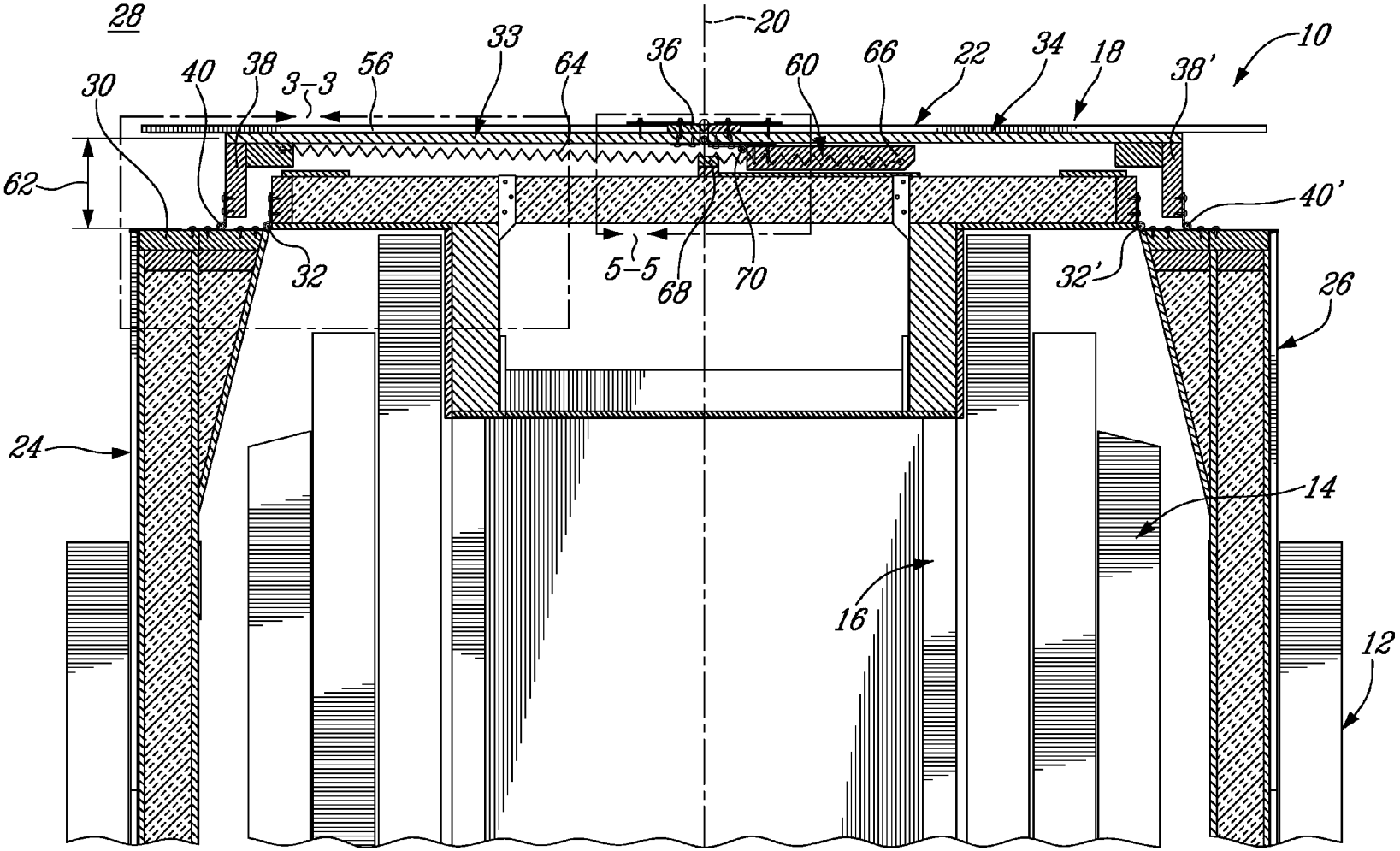
FIG. 1 is a transversal cross section view showing an example of a foldable habitation in a folded configuration.

In FIG. 1, an example of a foldable habitation 10 is shown in the folded. It can be seen that this foldable habitation has a flooring 12, and walls 14 which are deployable from a structural core 16 in a manner similar as the foldable habitation published in US Patent Application Publication No 2008/0236055. The foldable habitation 10 further has a foldable roof 18, the manner of connection of which with the structural core 16 will be described in detail. The foldable roof 18 can be deployed into the configuration shown in FIG. 2.

Referring to FIG. 1, the structural core 16 has an assembly of structural beams which can be either wood beams or metal beams. In this embodiment, and as will be discussed further below, the structural core 16 has sufficient structural resistance to support the entire foldable habitation 10 including roof 18, flooring 12 and walls 14, when lifted by its two longitudinal ends as will be discussed further below. The foldable habitation 10 can be seen to have two sides which are substantially symmetrical relative to a longitudinally and vertically oriented center plane 20.

The foldable roof 18 generally has a center section 22 located above the structural core 16, and two opposite lateral sections 24, 26, one on each side of the structural core 16. Because each side is symmetrical, only the left side 28 will be described in detail. The left side lateral section 24 has a proximal edge 30 which is foldably connected to the structural core 16 at a first fold axis 32. The center section 18 of the roof 22, includes a left side center section panel 33 and a right side center section panel 34, which are foldably connected to one another in the center. The left side center section panel 33 has a proximal end 36 at which it is connected to the right side center section panel 34, and a distal end 38. The distal end 38 is foldably (pivotally) connected not to the structural core 16, but rather to the left side lateral section 24 of the roof 18, in a manner to pivotally fold relative to it along a second fold axis 40.

Figure 3:
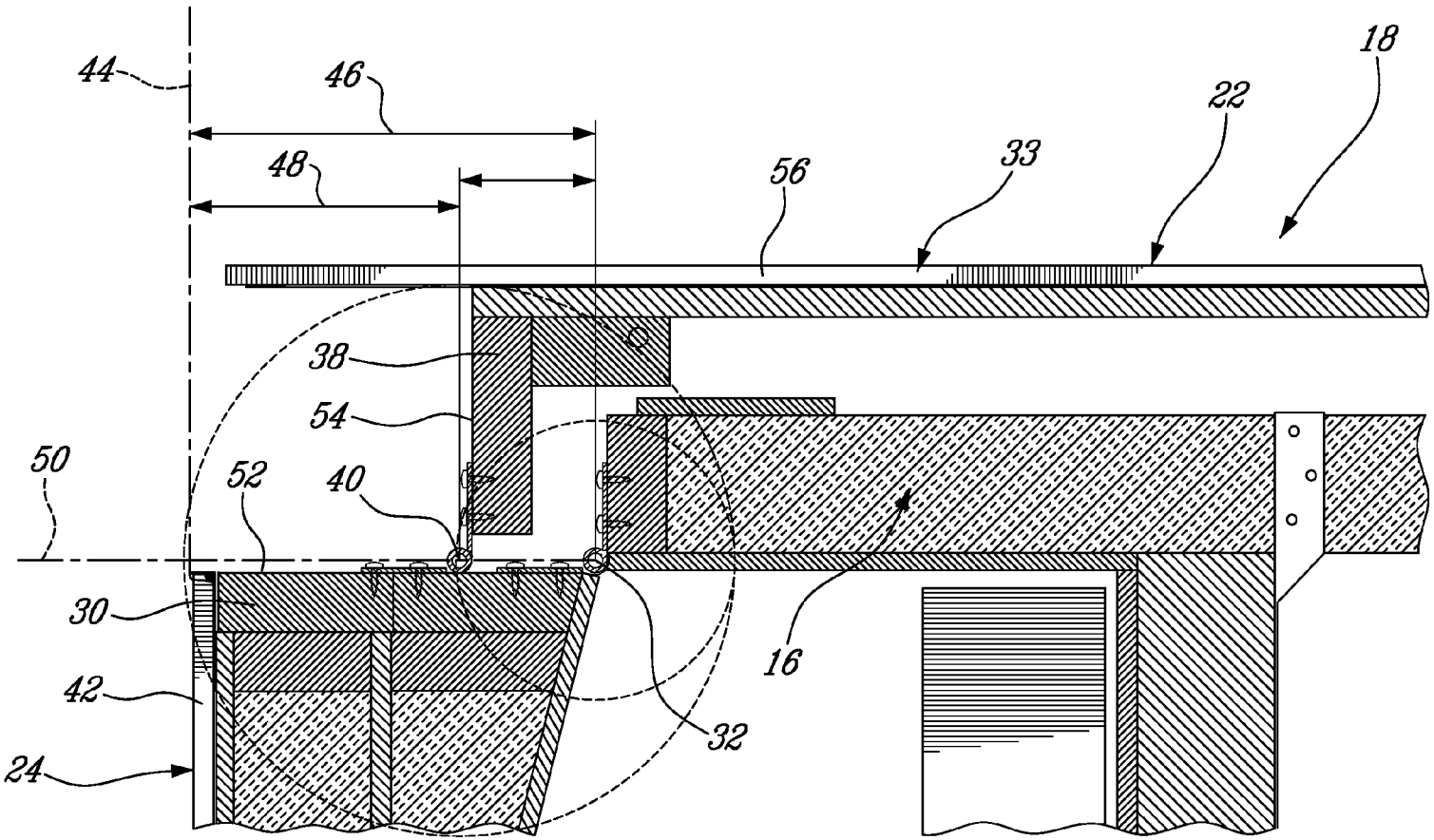
FIG. 3 is an enlarged view taken along lines 3-3 of FIG. 1.

Turning now to FIG. 3, in this embodiment, the first fold axis 32 and the second fold axis 40 correspond with hinges. The left side lateral section 24 has a lateral covering 42 which is exposed to the elements when deployed. The lateral covering 42 is planar, and so the expression <<covering plane 44>> is used herein to refer to a plane which roughly coincides with the lateral covering 42. It can be understood that the first fold axis 32 is inwardly spaced from the covering plane 44 by a first spacing distance 46. The second fold axis 40, about which the lateral section 24 is foldably connected to the central section 22 of the roof 18, is spaced from the covering plane 44 by a second spacing distance 48. The first spacing distance 46 is greater than the second spacing distance 48, as a result of which the second fold axis 40 rotates about the first fold axis 32 when the lateral section 24 is deployed. This moves the second fold axis 40 both upwardly and laterally-inward into the position shown in FIG. 4. This raises the central section 22 of the roof relative to the structural core 16.

Figure 4:
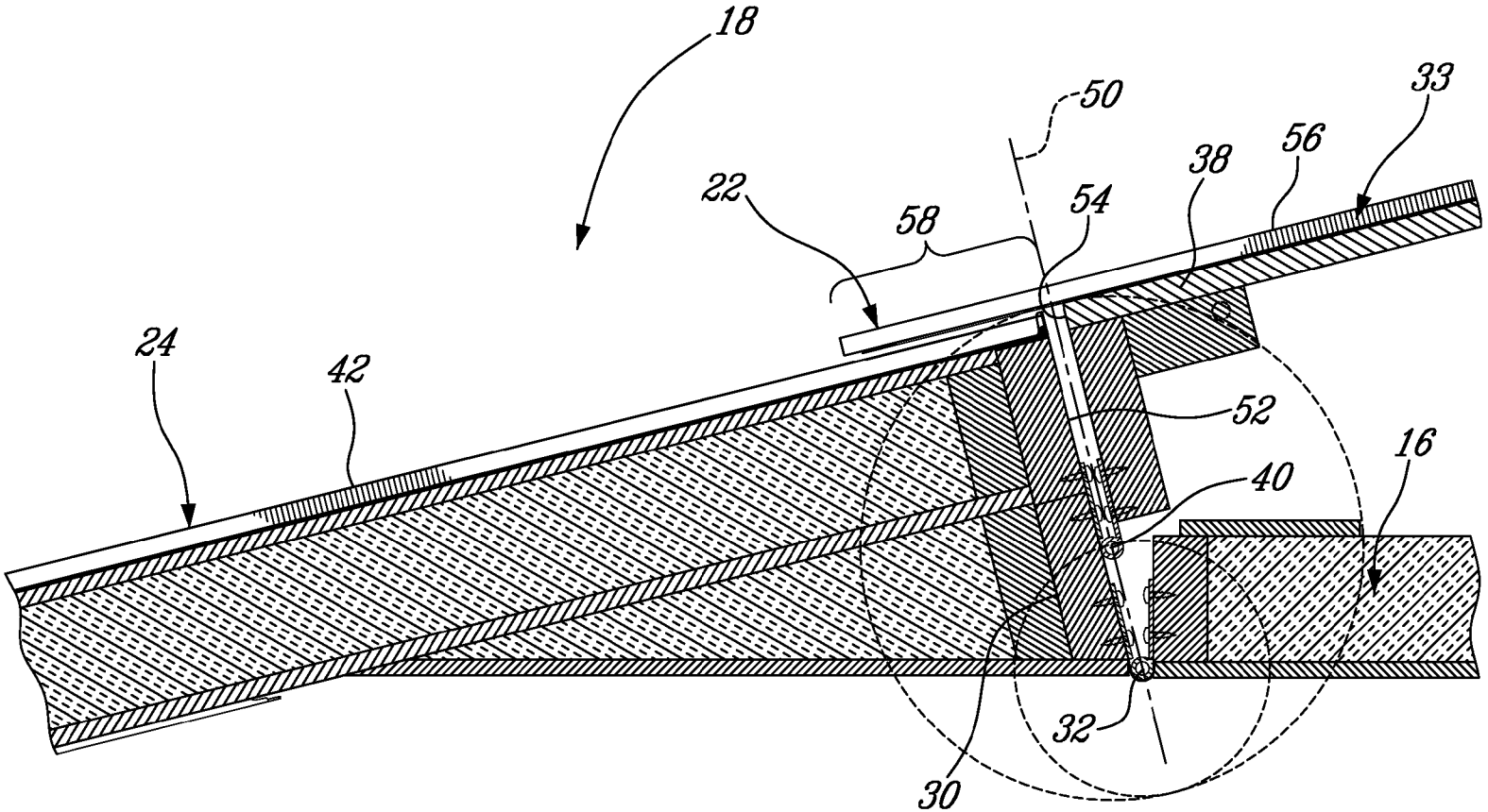
FIG. 4 is an enlarged view taken along lines 4-4 of FIG. 2.

Referring to FIG. 3, in this embodiment, the first fold axis 32 and the second fold axis 40 are both aligned, and positioned on a plane referred to as the axis plane 50. The axis plane 50 roughly corresponds to a planar surface 52 at the proximal edge 30 of the lateral section 24. In this embodiment, the planar surface 52 and the axis plane 50 are normal to the covering plane 44. The distal end 38 of the center section panel 33, can also be seen to have a planar surface 54 extending normal to a covering 56 of the center section 22, in this embodiment. The covering 56 of the center section panel 33 projects from the planar surface 54 at the distal end 38 of the center section panel 33, in a manner to provide overlapping 58 with the covering 42 of the lateral section 24 when deployed, as shown in FIG. 4.

Figure 2:
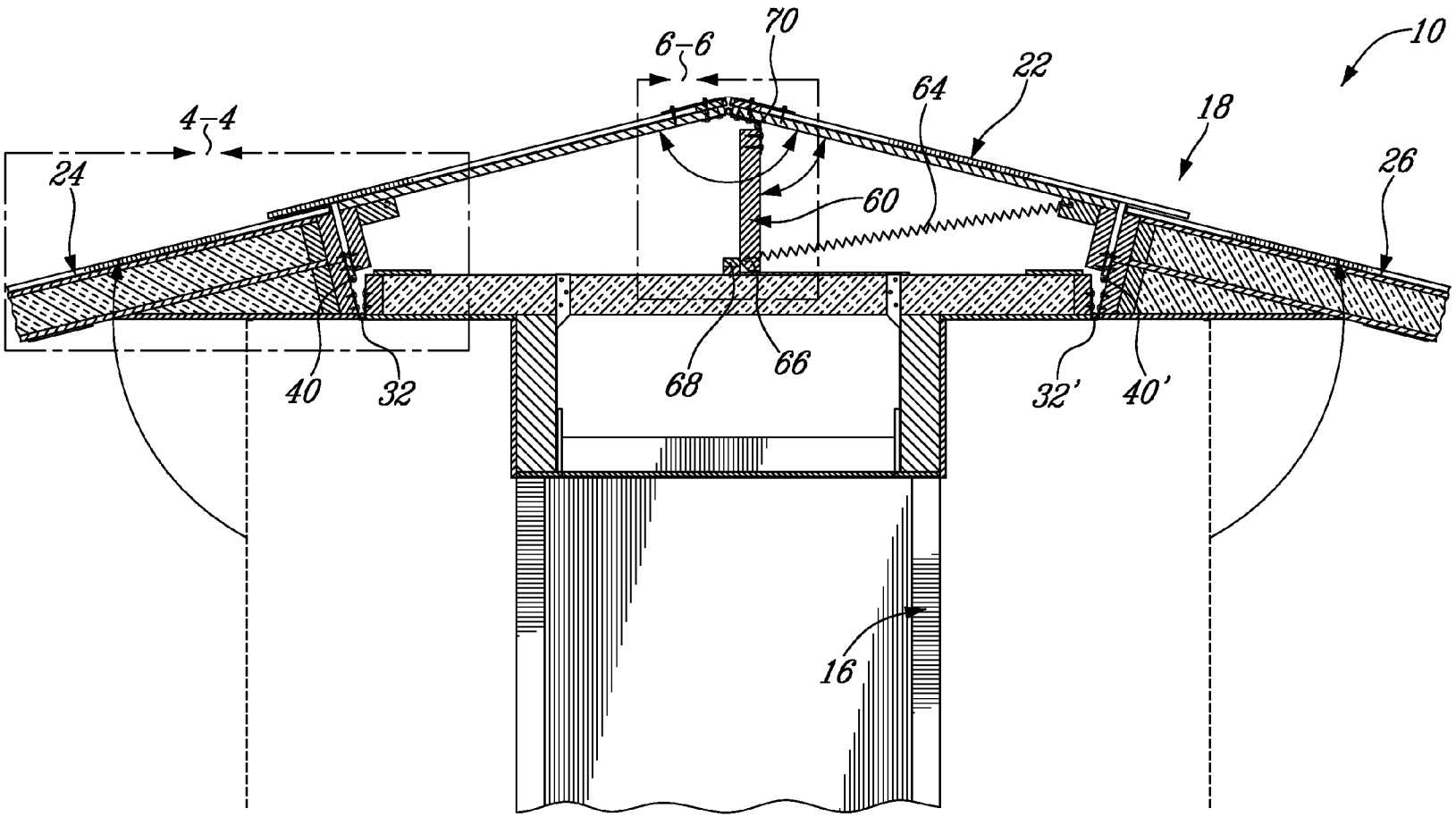
FIG. 2 is a view similar to FIG. 1 showing the foldable habitation in a deployed configuration.

Turning now to FIG. 2, the foldable habitation 10 is shown in the deployed configuration. As shown, when both the left side lateral section 24 and the right side lateral section 26 are deployed upwardly, a compressive force occurs between the left side second axis 40 and the right side second axis 40', which forces the center portion 22 to fold outwardly, relative to the structural core. Henceforth, the center section 22 of the roof 18 is automatically deployed when the lateral sections 24, 26 are deployed, and when folded in the folded configuration (FIG. 1), the central section 22 adopts a generally flat lowered configuration which is particularly adapted to make a fuller use of available rectangular prism-shaped space during shipping.

Referring still to the deployed configuration shown in FIG. 2, the center portion 22 of the roof 18 adopts a chevron shape when deployed. A support member 60 is pivotally mounted underneath the center portion 22 of the roof. This support member 60 can be positioned in a vertical orientation between the center portion 22 of the roof 18 and the structural core 16, to support the center portion 22 against the structural core 16. As shown in FIG. 1, a spacing distance 62 between the second fold axis 40 and the plane of the covering 56 of the center section 22 can be selected to allow housing the support member 60 between the central section 22 and the structural core 16, and thereby support the central section 22 of the roof 18 even when in the folded configuration.

Referring to FIG. 1 a spring 64, or other stretched elastic element, can be used between a distal end 66 of the support member 60 and a distal end 38' of a center section panel 34 on the other side of the foldable habitation 10, to pivotally bias the support member 60 toward the vertical orientation (shown in FIG. 2). The support member 60 can thus be configured to be automatically pivoted into position, with the distal end 66 thereof in abutment against a stop 68, as the center section 22 of the roof 18 is raised and deployed into the chevron shape shown in FIG. 2.

Prior to folding the foldable habitation from the deployed configuration shown in FIG. 2 to the folded configuration shown in FIG. 1, the spring 64 can be detached from the distal end 38' of the center section panel 34, and attached to the distal end 38 of the central section panel 33, in a manner to bias it toward the folded configuration for automatically folding when the lateral sections 24, 26 are folded.

The stretched elastic element is used in this embodiment only for convenience, though it will be understood to be entirely optional. In embodiments where the stretched elastic element is omitted, the support member 60 can be manually pivoted.

Figure 5:
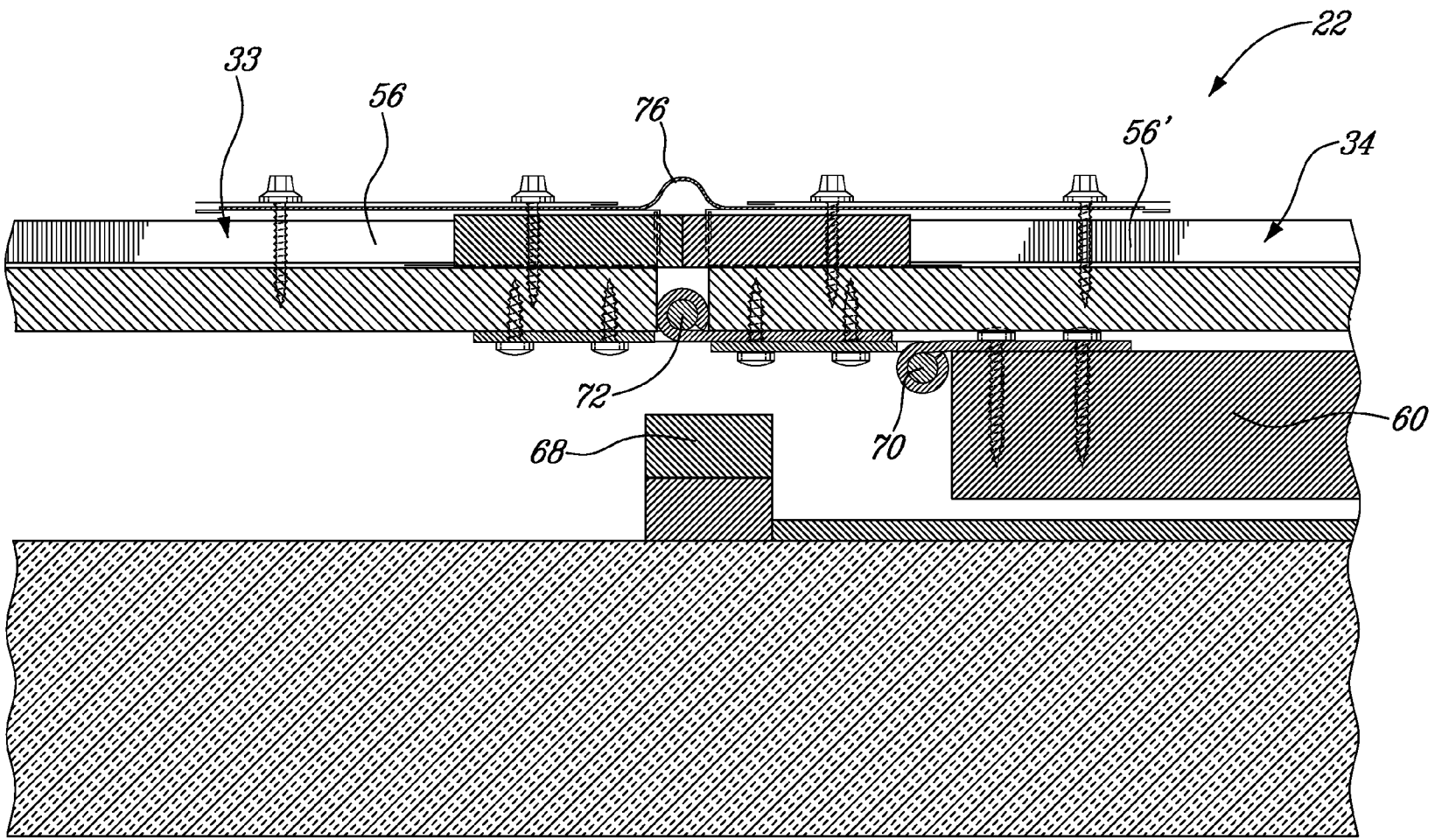
FIG. 5 is an enlarged view taken along lines 5-5 of FIG. 1.
Figure 6:
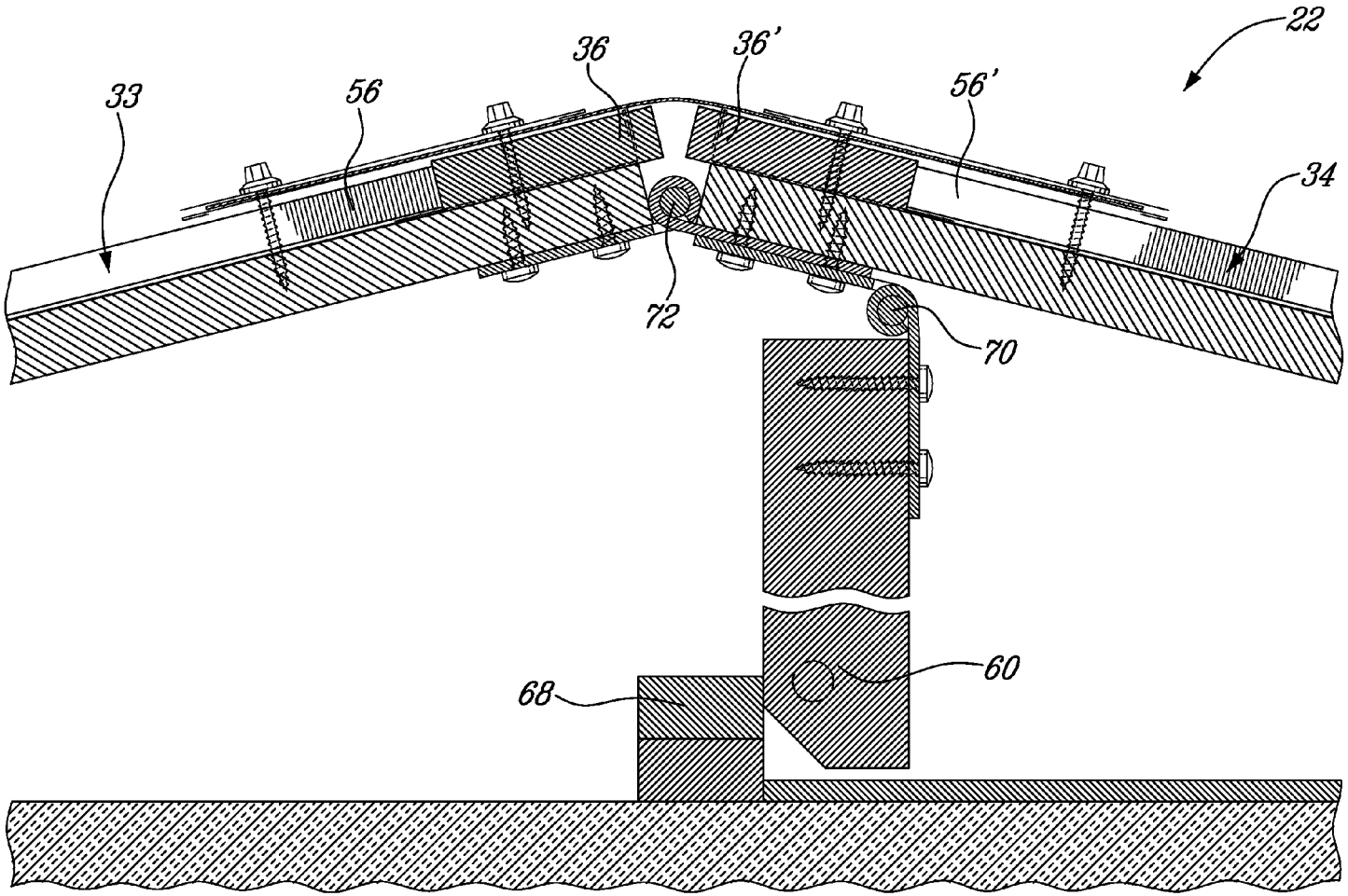
FIG. 6 is an enlarged view taken along lines 6-6 of FIG. 2.

The foldable connection 70 between the support member 60 and the center portion 22 of the roof is shown in greater detail in FIGS. 5 and 6, where the foldable connection 72 between the left side central panel section 33 and the right side central panel section 34 is also more clearly shown. In this embodiment, both these foldable connections 70, 72 are hinged. The stop 68 is also shown in greater detail. The support member 60 can thereafter be held in the vertical orientation by the weight of the center portion 22 of the roof Turning back to FIG. 5, a membrane 76 is provided between the coverings 56, 56' of the left side central section panel 33 and the right side central section panel 34. As it appears when turning to FIG. 6, the membrane is stretched between the two coverings 56, 56' when the foldable habitation is deployed and the central section of the roof is folded into the chevron shape, and can thus serve to provide an impervious seal preventing elements such as dirt, rainwater or snow to infiltrate between the proximal ends 36, 36' of the central panel section 33, 34 both when in the deployed configuration and when in the collapsed configuration.

It will be understood that all the folds occur along parallel axes.

Referring to FIG. 7, to put things more concisely, the deploying of the roof implies pivoting a first one of the two lateral sections about a first fold axis with which it is connected to the structural core (7C-7D), this also rotates the second fold axis around the first fold axis (see FIGS. 3 and 4) and thereby raises the distal end of the corresponding central section and moves it laterally inward, thereby partially raising the central section of the roof.

Walls can then be deployed under the deployed lateral roof section (7D-7E). Then, the other lateral section is pivoted in a similar manner as the first lateral section, which forces the distal ends of the central section panels towards one another and thereby forces the proximal ends of the central section panels upwardly, into the chevron shape, where the support member is moved into a vertical orientation for supporting the central section of the roof against the structural core (7E-7F). This can be followed by deploying remaining walls. It will be understood that this deploying method is highly simple, in that a limited number of steps are effected. Therefore, deployability is not unduly burdened. Nevertheless, this configuration allows folding the foldable habitation into a transport configuration wherein the central section of the roof becomes flat instead of chevron-shaped, and thereby saves space in a given storage space having a rectangular prism shape (7A or 7B).

Figure 7A:
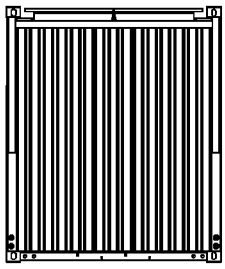
FIG. 7, includes FIG. 7A to FIG. 7H, which are a succession of front elevation views showing deployment of the foldable habitation of FIG. 1.
Figure 7B:
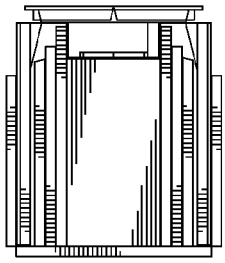
Figure 7C:
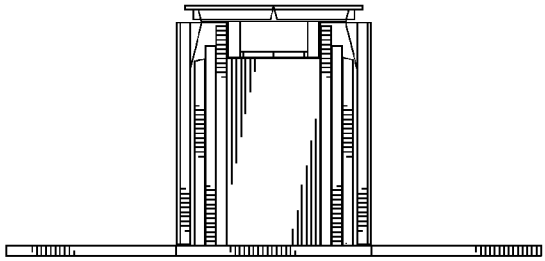
Figure 7D:
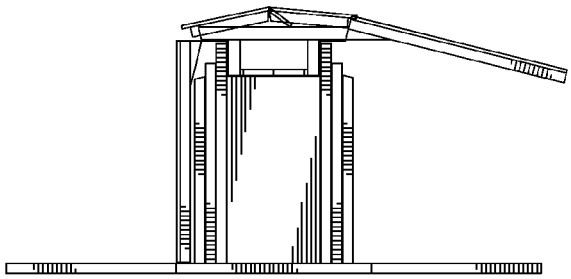
Figure 7E:
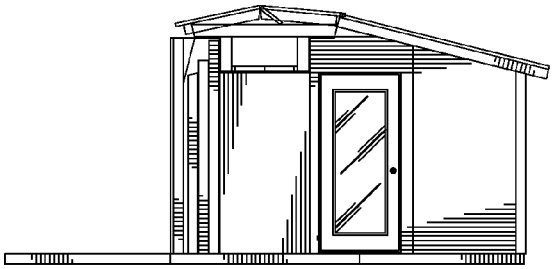
Figure 7F:
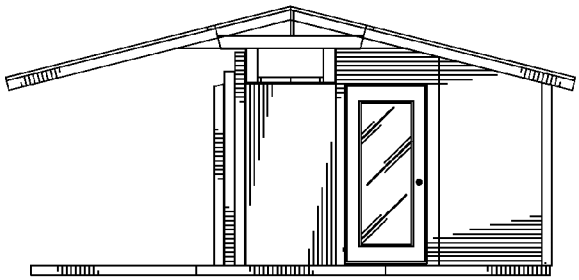
Figure 7G:
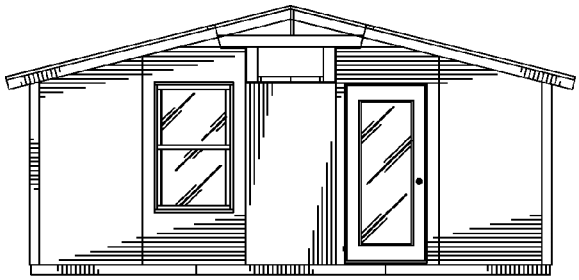
Figure 7H:
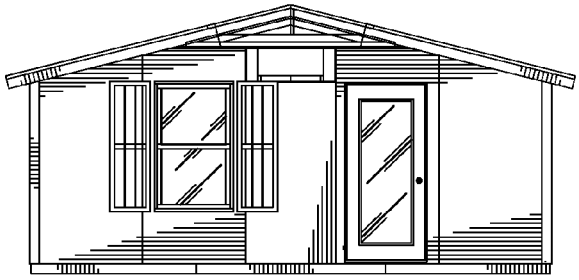

It will be understood that when the foldable habitation is in the transport configuration shown in FIG. 1 and FIG. 7A or 7B, it is susceptible to require transporting from one place to another. Transportation can occur from the factory to the area where the foldable habitation will be used, and can also occur when moving the foldable habitation from one site to another. Typically, the foldable habitation in the transport configuration can be carried by truck. However, many considerations can favour the desire to transport the foldable habitation overseas, or to store a number of foldable habitations in a limited volume storage space. At least in these two latter situations, for example, it can be desired to stack such foldable habitations atop one another to save horizontal space.

Figure 8:
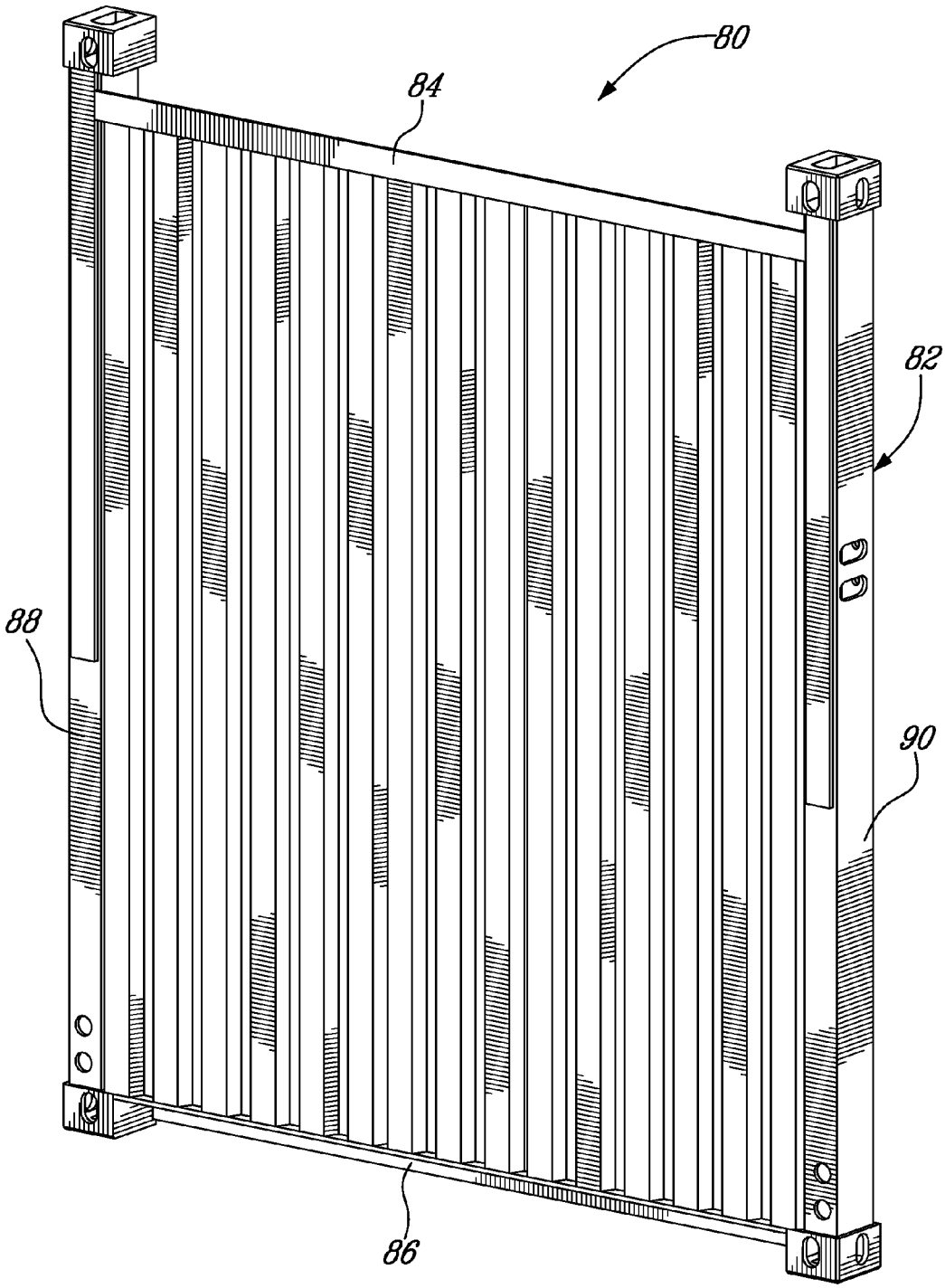
FIG. 8 is a front perspective view of a support frame for handling the foldable habitation of FIG. 1.
Figure 9:
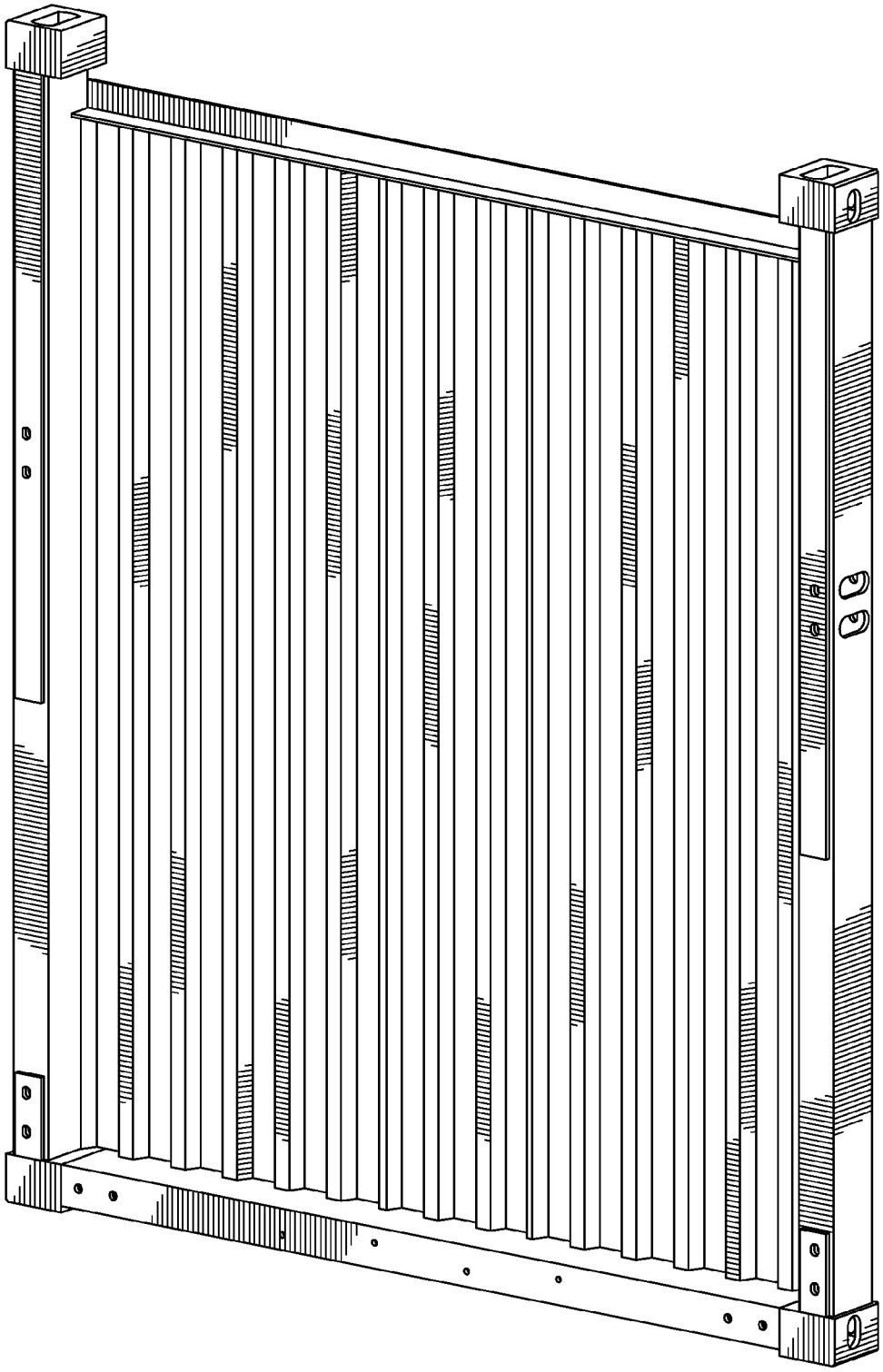
FIG. 9 is a rear perspective view of the support frame of FIG. 8.

FIG. 8 and FIG. 9 show an example of a support frame which can be used to provide stackability to the foldable habitation when in the folded configuration. Two such support frames can be fastened to the structural core of the foldable habitation, one at each longitudinal opposite end thereof, such as shown in FIG. 7A. The structural core of the foldable habitation can be made sufficiently structurally resistant for the foldable habitation to be manipulated by the two support frames, somewhat like a long beam. Henceforth, the foldable habitation with the two support frames mounted at longitudinally opposite ends thereof can be raised and suspended in midair by and between the two structural frames. The foldable habitation can then be lowered onto a truck, for example, or positioned at a given location, such as a storage space or in a ship for shipping overseas. A second foldable habitation also having two support frames at longitudinally opposite ends thereof can then also be raised in a similar manner, and the support frames of the second foldable habitation can be lowered onto and supported by the support frames of the first foldable habitation located underneath. The superposed frames can then be attached to one another and thereby secured for shipping, for example, in a configuration where the two superposed foldable habitations are not directly put into contact with each other.

In this configuration, the support frame 80 has an outer frame 82 which includes four beams 84, 86, 88, 90.

It can be ad advantageous when shipping foldable habitations overseas that the support frames be made in a manner that they can be disassembled to adopt a smaller volume configuration for occupying a limited amount of storage space during return shipping to the expeditor.

The embodiment described herein and illustrated is exemplary only. The scope is indicated by the appended claims.

What is claimed is:

1. A roof for a foldable habitation also having a structural core, a floor and walls, and being foldable between a transport configuration and a deployed configuration, the roof having a center section including two interconnected center section panels, each having a proximal edge and a distal edge and both being positioned above the structural core of the foldable habitation, and two lateral sections, the foldable roof being CHARACTERIZED IN THAT the two lateral sections are each foldably connected to a corresponding opposite side of the structural core of the foldable habitation, about two first fold axes, in that the two center section panels are each foldably connected at their distal edge to the corresponding lateral section, about two second fold axes, and each foldably connected to one another at their proximal edge, the first fold axes being interspaced from the corresponding second fold axis in a manner that the center section panels are automatically deployed into a chevron shape upon deploying the lateral sections of the roof, and comprising a rigid support member foldably connected underneath the center section panels and being deployable downwardly to support the center section panels against the structural core.

2. The roof of claim 1 wherein the first fold axes are interspaced from covering planes of the corresponding lateral sections by a first distance, and the second fold axes are interspaced from the corresponding covering planes by a second distance, the second distance being lesser than the first distance.

3. The roof of claim 2 wherein the corresponding ones of the first fold axes and the second fold axes are interspaced on corresponding axis planes.

4. The roof of claim 2 wherein the corresponding ones of the first fold axes and the second fold axes are interspaced on corresponding axis planes.

5. The roof of claim 1 wherein each one of the two center section panels has a projection which covers a section of the corresponding lateral section when deployed.

6. The roof of claim 1 wherein the two first fold axes and the two second fold axes are provided with corresponding hinges.

7. The roof of claim 1 further comprising a flexible waterproof membrane interconnecting coverings of the center section panels at the proximal ends thereof.

8. The roof of claim 1 wherein the rigid support member is spring biased in a manner to be automatically deployed upon deploying the center section panels into the chevron shape.

9. The roof of claim 1 wherein the foldable connection of the rigid support member is provided adjacent the proximal ends of the center section panels.

10. A method of deploying a roof of a foldable habitation with a structural core, comprising: deploying a lateral section of the roof by pivoting it relative to the structural core about a first horizontal axis located along an edge of the lateral section, the first horizontal axis being inwardly spaced from a covering plane of the lateral section of the roof, and thereby rotating a second horizontal axis located along the edge of the lateral section between the covering plane and the first axis and raising a center section of the roof foldably connected to the lateral section of the roof about the second horizontal axis; pivoting a support member pivotally connected underneath the center section of the roof downwardly and supporting the center section of the roof against the structural core with it; and repeating the deploying on another lateral section of the roof, on an opposite side of the structural core, wherein the rotating includes moving the second horizontal axis both upwardly and laterally-inward and folding the center section of the roof outwardly along its center.

* * * * *